US010647478B2

(12) United States Patent
Dreyer et al.

(10) Patent No.: US 10,647,478 B2
(45) Date of Patent: May 12, 2020

(54) CLOSURE FOR A CONTAINER, A TAMPER INDICATING BAND, A COMBINATION AND A METHOD

(71) Applicant: Obrist Closures Switzerland GmbH, Reinach (CH)

(72) Inventors: Lino Dreyer, Rixheim (FR); Sebastien Cedric Widmer, Landser (FR)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 67 days.

(21) Appl. No.: 15/315,118

(22) PCT Filed: May 29, 2015

(86) PCT No.: PCT/EP2015/062035
§ 371 (c)(1),
(2) Date: Nov. 30, 2016

(87) PCT Pub. No.: WO2015/185465
PCT Pub. Date: Dec. 10, 2015

(65) Prior Publication Data

US 2018/0134462 A1 May 17, 2018

(30) Foreign Application Priority Data

Jun. 3, 2014 (GB) ..... 1409834.7

(51) Int. Cl.
*B65D 41/34* (2006.01)
*B65D 1/02* (2006.01)

(52) U.S. Cl.
CPC ..... *B65D 41/3442* (2013.01); *B65D 1/0246* (2013.01); *B65D 41/3447* (2013.01); *B65D 41/3457* (2013.01)

(58) Field of Classification Search
CPC ..... B65D 41/3442; B65D 1/0246; B65D 41/3447; B65D 41/3457
(Continued)

(56) References Cited

U.S. PATENT DOCUMENTS 3,235,115 A * 2/1966 Duke ..... B65D 41/3409 215/252
4,007,848 A 2/1977 Snyder
(Continued)

FOREIGN PATENT DOCUMENTS

CN 1231641 A 10/1999
DE 3233806 A1 * 3/1984 ..... B65D 41/3442
(Continued)

OTHER PUBLICATIONS

First Office Action for Corresponding Chinese Application No. 201580029546.2, dated Oct. 9, 2017.
(Continued)

*Primary Examiner* — James N Smalley
(74) *Attorney, Agent, or Firm* — Hauptman Ham, LLP

(57) ABSTRACT

A closure for a container, the closure comprising a top panel, a skirt extending from the periphery of the top panel, and a tamper indicating band frangibly connected to an open end of the skirt at a line of weakness, the band including a retaining segment (109) on an inner surface thereof so arranged, when the closure is in a closed position on a neck of the container, to engage under an engagement surface of a retaining structure arranged on the container neck, wherein the tamper indicating band includes at least one indent (117) arranged on an outer surface of the tamper indicating bond.

18 Claims, 9 Drawing Sheets

(58) Field of Classification Search
USPC ..... 215/252
See application file for complete search history.

(56) References Cited

U.S. PATENT DOCUMENTS

| | | | | | |
|---|---|---|---|---|---|
| 4,907,708 | A * | 3/1990 | Csaszar | B65D 41/3452 | 215/252 |
| 4,915,244 | A * | 4/1990 | Celaschi | B65D 41/3409 | 215/252 |
| 6,357,628 | B1 * | 3/2002 | Long, Jr. | B65D 41/3447 | 222/153.06 |
| 2004/0069738 | A1 * | 4/2004 | Orth | B65D 41/3447 | 215/252 |
| 2013/0270272 | A1 * | 10/2013 | Smith | B65D 41/0414 | 220/288 |

FOREIGN PATENT DOCUMENTS

| | | | | |
|---|---|---|---|---|
| DE | 3233806 | A1 | 3/1984 | |
| EP | 0343102 | A2 | 11/1989 | |
| EP | 0475672 | A1 | 3/1992 | |
| EP | 1048585 | A2 | 11/2000 | |
| EP | 1151932 | A1 * | 11/2001 | B26D 3/08 |
| FR | 2786466 | | 6/2000 | |
| FR | 2786466 | A1 | 6/2000 | |
| JP | S64-84855 | A | 3/1989 | |
| WO | WO 2004/014742 | A2 | 2/2004 | |
| WO | WO-2004/014742 | A2 | 2/2004 | |
| WO | WO-2005/019059 | A1 | 3/2005 | |
| WO | WO-2006/011002 | A1 | 2/2006 | |
| WO | WO-2012/095501 | A1 | 7/2012 | |

OTHER PUBLICATIONS

International Patent Application No. PCT/EP2015/062035, Search Report and Written Opinion dated Aug. 21, 2015, 15 p.
United Kingdom Patent Application No. GB1409834.7, Search Report dated Nov. 12, 2014, 6 pgs.
Second Office Action for Corresponding Chinese Application No. 201580029546.2, dated Sep. 5, 2018.

* cited by examiner

CLOSURE FOR A CONTAINER, A TAMPER INDICATING BAND, A COMBINATION AND A METHOD

This application is a U.S. National Stage Filing under 35 U.S.C. 371 from International Application No. PCT/EP2015/062035, filed on May 29, 2015, and published as WO 2015/185465 A1 on Dec. 10, 2015, which claims the benefit of priority to United Kingdom Patent Application No. 1409834.7, filed on Jun. 3, 2014, each of which is hereby incorporated by reference herein in its entirety.

TECHNICAL FIELD

Aspects relate, in general, to a closure for a container, and more particularly, although not exclusively, to a closure for a container, a tamper indicating band, a combination of closure and container and a method.

BACKGROUND

Molded plastic closures which can be threadably applied to associated containers for packaging products such as carbonated and non-carbonated beverages for example have met with widespread success in the marketplace.

Closures of this nature can be efficiently formed by compression molding and injection molding techniques, with the closures configured for tamper-evidence as may be required for some applications. These types of closures can provide highly effective sealing performance, even when used with containers having pressurized contents, with the threaded nature of the closures facilitating convenient removal, and re-application, by consumers.

In a manufacturing environment, it is desirable to be able to produce as many closures as possible in a given period of time, and for the closures to be applied to a suitable container. Therefore, in a typical molding process, a molded closure will be ejected from the molding apparatus before the closure has had time to completely cool. Particular regions of a closure can take longer to cool than others, especially if they comprise more material, and therefore have a greater mass in such regions. Such 'hot spots' can, by virtue of the fact that they take longer to cool, deform when the closure is ejected from the molding apparatus. Deformation as a result of this is particularly problematic in molding apparatus in which a fast cycle time is employed.

Generally speaking, it is desirable to reduce closure mass so that cooling is accelerated and raw material consumption is reduced and throughput increased.

SUMMARY

According to an example, there is provided a closure for a container, the closure comprising a top panel, a skirt extending from the periphery of the top panel, and a tamper indicating band frangibly connected to an open end of the skirt at a line of weakness, the band including a retaining segment on an inner surface thereof so arranged, when the closure is in a closed position on a neck of the container, to engage under an engagement surface of a retaining structure arranged on the container neck, wherein the tamper indicating band includes at least one indent arranged on an outer surface of the tamper indicating band.

The or each (in the case that there is more than one for example) indent can be arranged on the outer surface of the tamper indicating band substantially opposite to the retaining segment. For example, the retaining segment is provided on an inside surface of the tamper indicating band, and an indent is provided on the outside of the tamper indicating band substantially in axial alignment with the retaining segment. For example, when viewed in cross section, an indent can be broadly arranged to be axially in line with a retaining segment. As the tamper indicating band is relatively thicker at the portion thereof that includes the retaining segment, an indent so arranged on the band can be provided without compromising the structural integrity of the closure or band, whilst reducing weight and providing a hinge effect that can be beneficial when the closure is applied to a container so that the band can flex over a retaining structure of a closure without damaging the band or closure. In an example, an (or the, if more than one is present) indent can be offset, in an axial direction, with respect to the retaining segment. In the case that there are multiple indents, some can be offset with other not. An offset can be axially up or down the width of the tamper indicating band. Furthermore, in an example, the depth, shape and profile of indents can be the same or different.

The retaining segment can be a radially inwardly extending segment. The segment can be an annular retaining band. The annular retaining band can be interrupted to form multiple retaining segments on the inner surface of the tamper indicating band for the closure. The or each retaining segment can be profiled or tapered in a circumferential direction at at least one end thereof. The or each retaining segment can be profiled or tapered in an axial direction. The at least one indent can be an annular channel extending circumferentially around the outer surface of the tamper indicating band. The annular channel can be interrupted, whereby to provide multiple indents on the outer surface of the tamper indicating band. Sidewalls of the at least one indent can diverge from one another in a radial direction. The at least one indent can have a curved cross-section. The tamper indicating band can include multiple rows each including at least one indent. The multiple rows can be arranged in axially spaced relation on the tamper indicating band. Multiple indents can be provided in each row, whereby to provide respective circumferentially spaced rows of indents. Respective circumferential rows of indents can be arranged to provide an overlap in an axial direction between respective ones of the indents of the rows.

According to an example, there is provided a closure for a container, the closure comprising a top panel, a skirt extending from the periphery of the top panel, and a tamper indicating band frangibly connected to an open end of the skirt at a line of weakness, the band including a retaining segment on an inner surface thereof, wherein the tamper indicating band includes at least one indent arranged on an outer surface of the tamper indicating band. The or each indent can be arranged on the outer surface of the tamper indicating band substantially opposite to the retaining segment. The retaining segment can be a radially inwardly extending segment. The segment can be an annular retaining band. The annular retaining band can be interrupted to form multiple retaining segments on the inner surface of the tamper indicating band for the closure. The annular retaining band can comprise multiple retaining segments on the inner surface of the tamper indicating band for the closure. The or each retaining segment can be profiled or tapered in a circumferential direction at at least one end thereof. The or each retaining segment can be profiled or tapered in an axial direction. The at least one indent can be an annular channel extending circumferentially around the outer surface of the tamper indicating band. The annular channel can be interrupted, whereby to provide multiple indents on the outer surface of the tamper indicating band. That is, multiple discrete indents can be provided. The at least one indent can comprise a depression or pit in the outer surface of the tamper indicating band. The depression or pit can extend circumferentially around at least a portion of the tamper indicating band. The tamper indicating band can include multiple indents arranged on the outer surface of the tamper indicating band. The multiple indents can be arranged in circumferentially spaced relation on the outer surface of the tamper indicating band. Sidewalls of the at least one indent can diverge from one another in an outwardly radial direction. The at least one indent can have a curved cross-section. The tamper indicating band can include multiple rows each including at least one indent. The multiple rows can be arranged in axially spaced relation on the tamper indicating band. Multiple indents can be provided in each row, whereby to provide respective circumferentially spaced rows of multiple indents. Respective circumferential rows of indents can be offset with respect to one another or arranged to provide an overlap in an axial direction between respective ones of the indents of the rows.

According to an example, there is provided a tamper evident band for frangible connection to an open end of a skirt extending from the periphery of a top panel of a closure, the band including a retaining segment on an inner surface thereof so arranged, when the closure is in a closed position on a neck of the container, to engage under an engagement surface of a retaining structure arranged on a container neck, wherein the tamper indicating band includes at least one indent arranged on an outer surface of thereof opposite to the retaining segment.

According to an example, there is provided in combination, a closure as provided herein and a container including a retaining structure arranged on a neck of the container, the retaining structure including an engagement surface under which the retaining segment engages when the closure is in a closed position on a neck of the container. The container neck can include an external thread formation and wherein the skirt of the closure includes at least one internal thread formation for cooperating engagement with the external thread formation on the said container neck. The external and internal thread formations can be helical thread formations.

According to an example, there is provided a method for reducing weight of a closure, the method including providing at least one indent arranged on an outer surface of a tamper indicating band frangibly connected at a line of weakness to an open end of a skirt extending from the periphery of a top panel of the closure, the indent arranged on the band substantially opposite to a retaining segment arranged on an inner surface of the tamper indicating band, whereby to form a trough on the tamper indicating band. Multiple indents can be provided on the outer surface of the tamper indicating band in circumferentially spaced relation.

BRIEF DESCRIPTION OF THE DRAWINGS

Embodiments will now be described, by way of example only, with reference to the accompanying drawings, in which.

DESCRIPTION

Figure 1:
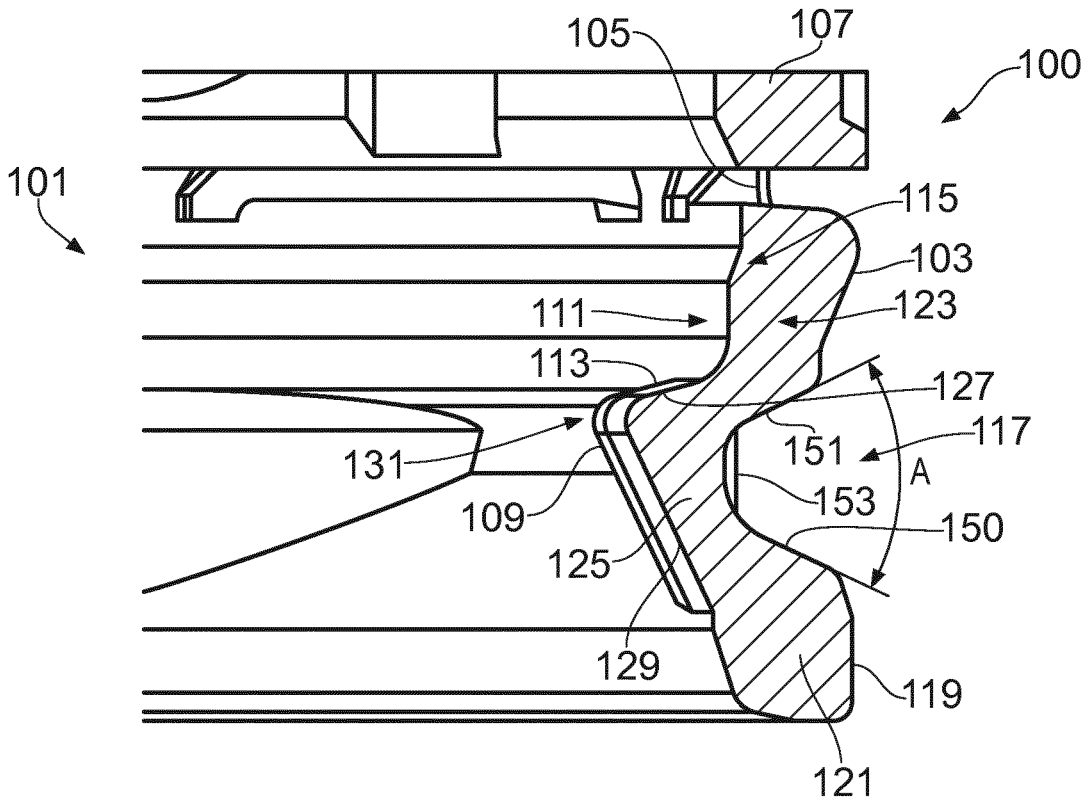
FIG. 1 is a schematic representation of a portion of a closure for a container according to an example.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

FIG. 1 is a schematic representation of a portion of a closure for a container according to an example. FIG. 1 shows, in cross-section, a portion of a closure 100 attached to a container 101. More specifically, FIG. 1 shows a tamper indicating band 103 of the closure 100. Band 103 is frangibly connected at 105 to an open end of a skirt 107 extending from the periphery of a top panel (not shown) of the closure 100. According to an example, the band includes a retaining segment 109 on an inner surface 111 of the band. The retaining segment 109 is arranged so that, when the closure is in a closed position on a neck of the container as depicted in FIG. 1, it engages under an engagement surface 113 of a retaining structure 115 arranged on the container neck.

According to an example, the tamper indicating band 103 includes at least one indent, depression or pit 117 arranged on an outer surface 119 of the tamper indicating band 103. The indent can present an angle A to the outside of the band 103. In an example, angle A can be selected from the range 1-179°. In an example, angle A can be selected from the range 30-135°. In an example, angle A can be selected from the range 15-100°.

In an example, the indent is so arranged as to be broadly or substantially opposite to the retaining segment 109, or offset in an axial direction with respect to the position of the retaining segment 109. As shown in FIG. 1, the indent 117 (also referred to as a hollow or trough) is provided at a position that is substantially opposite the retaining segment 109. Accordingly, the width of the tamper evident band 103 does not go below a predetermined minimum value for thickness, thereby maintaining a structural integrity of the band 103 whilst enabling a saving in raw material to be made by virtue of a reduction in mass of the band 103 at the area of the indent 117. In an example, the tamper indicating band can be in the range of 2.5-4.5 mm, preferably around 3 mm, in length. Top and bottom portions of the band 103 can have a thickness in the range of 0.35-0.95 mm, preferably around 0.65 mm, and the retaining segment/indent combination which generally lies between the top and bottom portions of the band 103 can have a thickness in the range of 0.4-1 mm, preferably around 0.70 mm.

Without an indent or channel, the width of the tamper-indicating band 103 at the region where a retaining segment is included is relatively thick compared with the rest of the band. The reduction of mass of the band 103 at the region of the indent provides a further advantage in that cooling of the band in these regions is faster than would be the case if the indent was not provided. As mentioned above, bulky areas of a molded plastics closure form hot spots that can take longer to cool than is desirable. For example, in a high throughput manufacturing environment, it is desirable for molded components to cool as quickly as possible so that they can be packaged and/or applied to or on other components. The provision of an indent 117 reduces the amount of material in this region of the band 103, thereby enabling faster cooling.

A further advantage is that the indent can act as a form of hinge that enables some flex of the band 103, particularly as the closure is applied to a container. For example, as the closure is applied to a container, the retaining segment 109 has to pass over the retaining structure 115 of the container 101 and 'snap' back into place so that it comes to rest underneath the structure 115. This can result in trauma to the closure 103 as it stretches to pass over the container neck. The indent 117 acts as a hinge enabling the lower part of the band 103, generally depicted at 121, to flex relative to the upper part of the band 103, generally depicted at 123.

As the band 103 is passed over the container neck, parts 123 and 121 can move relative to one another, such as towards each other, with the indented part 117 of the band 103 in between the parts 123 and 121 effectively acting as a hinge portion 125. Accordingly, in the process of application to a container, the angle A subtended by the indent effectively reduces as the top and bottom portions come together. The provision of an indent 117 enables a reduction in rigidity of the band 103 that enables it to be placed into position on container neck without damaging the band 103, the closure or the container.

According to an example, the retaining segment 109 is a radially inwardly extending segment, which can be an annular retaining band for example. That is, the segment 109 can be an annular band that extends circumferentially around an inner surface of band 103. As depicted in FIG. 1, the segment 109 can have a profile that enables it to engage under engagement surface 113 of structure 115. For example, in cross-section, as depicted in FIG. 1, the segment 109 can include an upper surface 127 and a lower surface 129 joined at a shoulder portion 131, which can be rounded for example. Upper surface 127 can present an acute angle to the horizontal, and lower surface 129 can present an acute angle to the vertical. This can be advantageous to enable lower surface 129 to 'slide' over structure 115 when the closure 103 is applied to the container 101 with less force than if it presented a more severe angle, the reduction in effort compounded by the provision of hinge portion 125, with surface 127 abutting robustly against surface 113 such that the force required to remove the closure from the container when it is in place is greater than the force that would be required to break the tamper evident band away from the skirt. However, it will be appreciated that the profile and shape of the segment 109 can be any suitable profile, and the shape shown in FIG. 1 or the features noted above are not intended to be limiting.

In an example, in the case that segment 109 is in the form of an annular band, it can be periodically interrupted in order to form multiple retaining segments on the inner surface of the tamper indicating band for the closure. That is, multiple such segments 109 can be provided on the inner surface of the band 103. The periodic interruption can be such that the multiple segments are evenly spaced around the inner surface, or can be such that the spacing is uneven. The interruptions can be different in size so that multiple segments are provided respective ones of which can be different sizes. For example, some segments can be longer than others. Accordingly, in an example, multiple retaining segments can be provided in circumferentially spaced relation on an inner surface of the tamper indicating band.

Figure 2:
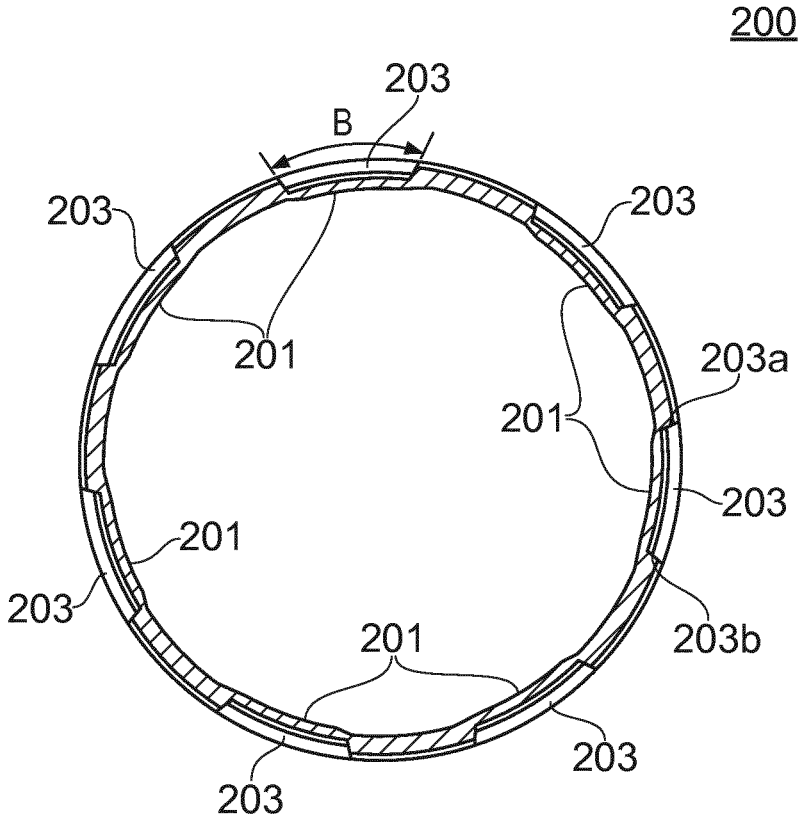
FIG. 2 is a schematic representation in plan and cross section of a closure according to an example.

FIG. 2 is a schematic representation in plan and cross section of a closure according to an example. As can be seen from FIG. 2, multiple retaining segments 201 are provided on closure 200, along with multiple corresponding indents 203. It is possible that a retaining segment 201 can be provided without a corresponding indent 203, and vice versa.

Figure 3:
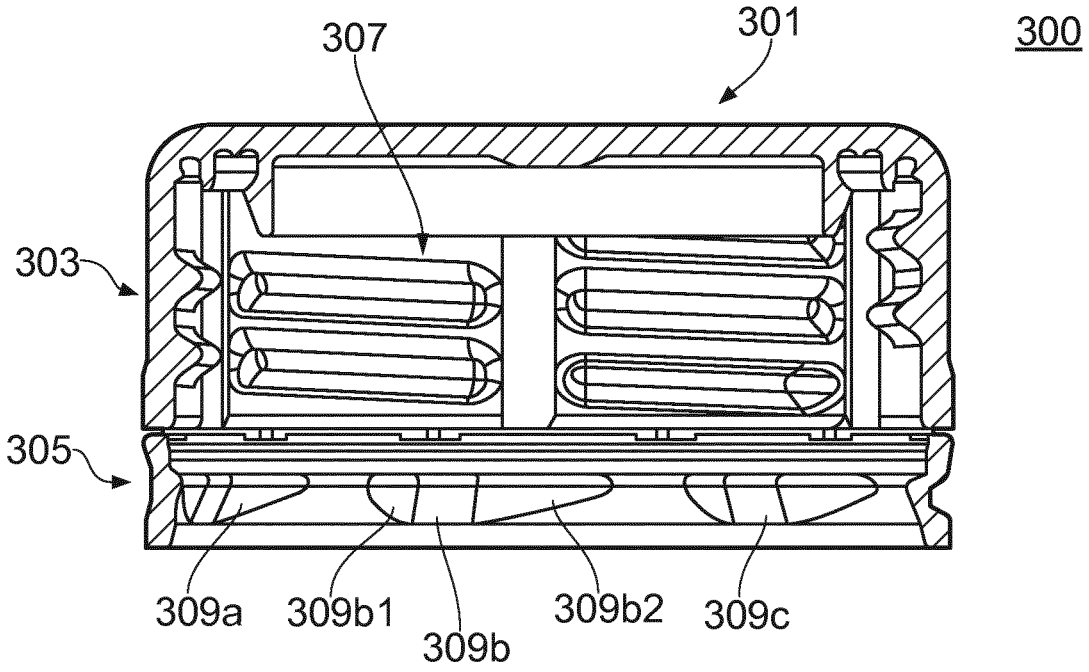
FIG. 3 is a schematic side representation of a cross section of a closure according to an example.

FIG. 3 is a schematic side representation of a cross section of closure according to an example. Closure 300 has a top panel 301, a skirt 303 extending from the periphery of the top panel 301, and a tamper indicating band 305 that is frangibly connected to an open end of the skirt at a line of weakness. An inner thread formation 307, such as a helical thread formation, is provided on an inside surface of the skirt 303. The thread formation 307 can cooperatively engage with an external thread formation (not shown) on the container neck.

As can be seen in FIG. 3, multiple retaining segments 309*a-c* are shown. Further such segments can be provided as will be appreciated. Each segment can be profiled or tapered in a circumferential direction at at least one end thereof. For example, with reference to segment 309*b*, end portions 309*b*1 and 309*b*2 can be profiled so as to taper, thereby reducing weight of the closure.

According to an example, an indent 117 can be an annular channel extending circumferentially around the outer surface of the tamper indicating band 103, 305. That is, an indent can be provided that extends around the whole of the tamper indicating band, thereby forming a channel around said band. In an example, multiple indents can be provided, as depicted for example in FIG. 2. As such, this can be considered to be equivalent to the case that an annular channel around the band 103, 305 is interrupted, whereby to provide the multiple indents on the outer surface of the band. As will be appreciated, the multiple indents or troughs can be evenly or unevenly spaced around the band, and can be provided with the same or differing circumferential lengths, B (as depicted in FIG. 2).

Sidewalls (150, 151 as shown in FIG. 1, or 203*a*, 203*b* as shown in FIG. 2, or some combination) of at least one indent can diverge from one another in a radial direction. This can aid removal of the closure from a mold, as will be appreciated, and can also provide an aesthetically pleasing finish. The 'floor' 153 of an indent can be curved, as shown in cross-section in FIG. 1, although it will be appreciated that other profiles can be used as desired.

Figure 4:
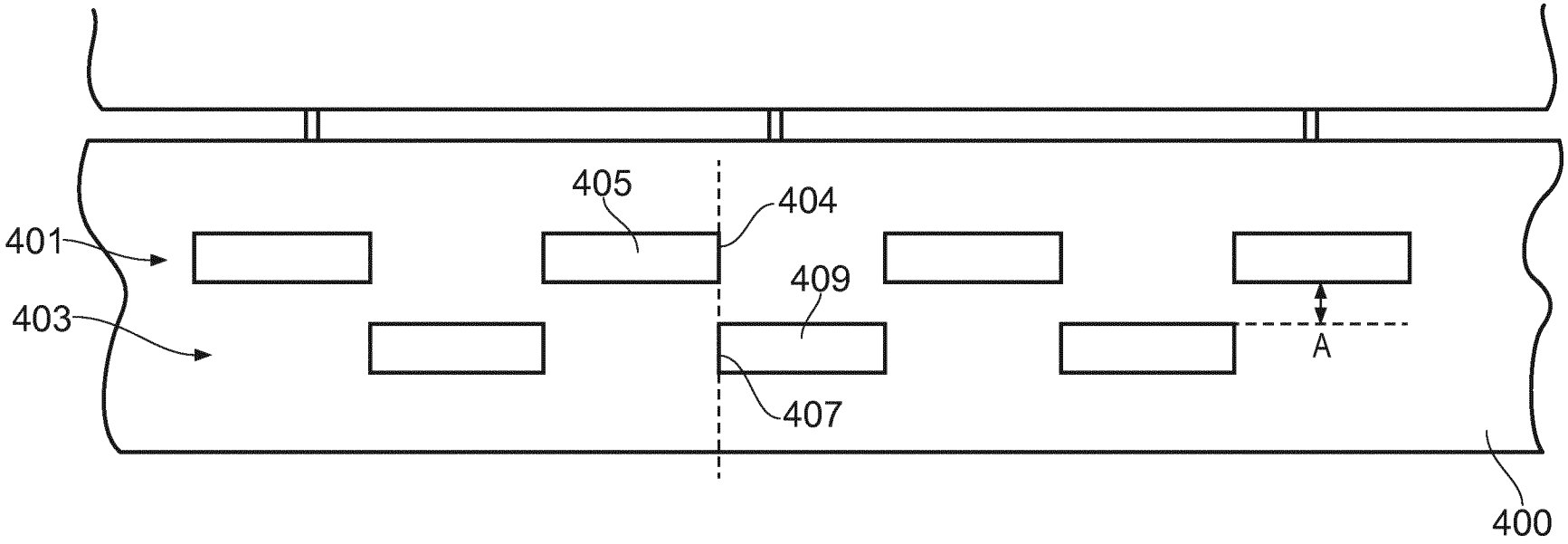
FIG. 4 is a schematic representation of a cross section of a closure according to an example.

FIG. 4 is a schematic representation of a portion of a closure according to an example. In the example of FIG. 4, multiple rows of circumferentially arranged indents are provided on a tamper evident band 400. The rows of circumferential indents are offset from one another, whereby to provide an upper row 401 and a lower row 403. That is, the rows of indents can be displaced from one another in an axial direction by a distance A, which can be a distance of the order of 1 to several mm for example, and individual indents of the rows can be offset to form an alternating pattern of indents for the band 400. For example, an edge 404 of an indent 405 in the upper row 401 can be axially in line with an edge 407 of an indent 409 of the lower row 403. In an example, a space can be provided, in a radial direction, between the edge of an indent in the upper row and the edge of a neighboring indent in the lower row. That is for example, edges 404 and 407 could be offset by a radial displacement. A combination of the two alternative indent positioning arrangements can be provided, or indents in adjacent rows can overlap by a desired degree, such as in a circumferential direction for example.

In the example of FIG. 4, two offset rows of circumferentially spaced indents are provided. It will appreciated the further rows can be provided.

Figure 5:
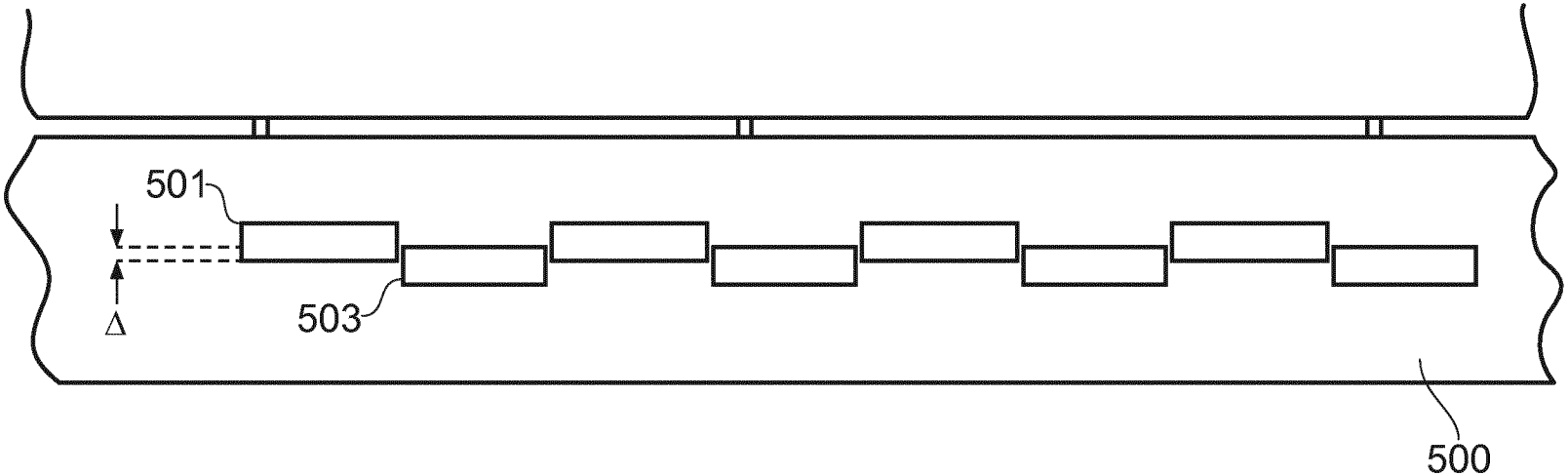
FIG. 5 is a schematic representation of a cross section of a closure according to an example in which three rows of circumferentially spaced indents are provided.

FIG. 5 is a schematic representation of a portion of a closure according to an example in which two rows of circumferentially spaced indents are provided on a tamper indicating band 500. As can be seen from FIG. 5, the rows of indents 501, 503 can be arranged so that there is an overlap, Δ, in the axial direction between respective ones of the indents. More particularly, the overlap is between the bottom of an indent in the top row 501 and the top of an indent in the bottom row 503. In the example of FIG. 5, in order to enable the overlap, it will be appreciated that there is no overlap between indents in respective ones of the rows in the radial direction, and the indents of the bottom row can be narrower so as to fit within the gaps between indents of the top row 501 for example. Alternatively, the indents of the rows can be of the same dimensions as will be appreciated.

Figure 6:
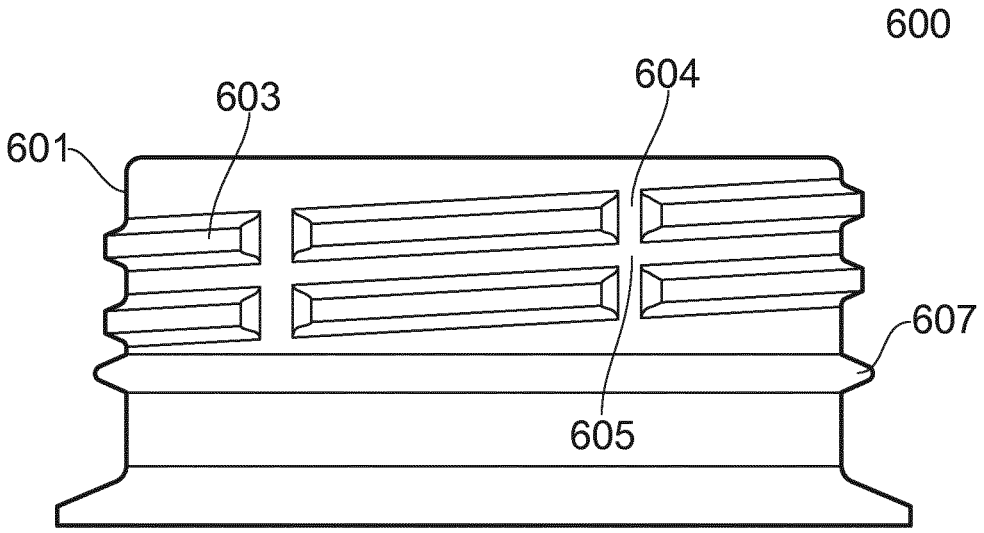
FIG. 6 is a schematic representation of a portion of a container according to an example.

FIG. 6 is a schematic representation of a portion of a container according to an example. More particularly, FIG. 6 is a side view of a container finish forming the neck of the container according to an example. The container finish 600 has an essentially cylindrical outside surface 601 with a thread 603, such as a helical thread. The container finish 600 can include several venting recesses 604, said venting recesses 604 interrupting the thread 603. Some venting recesses 604 can be axially aligned and form a venting slot 605 to enable excess gas to vent, such as in the case that a carbonated liquid is stored in the container. In an example, fewer recesses may be provided, or there may be no venting recesses, in which case thread 603 can be continuous around the outside surface 601 of the container 600. The container finish 600 can include a retaining structure arranged on the container neck such as a circumferential retaining bead 607 for use with a tamper indicating band of a closure to be applied. The bead 607 can protrude radially outwards.

The thread 603 is arranged to engage with a corresponding thread on the inside of a closure as described herein. In an example, the circumferential length of the thread 603, the width of the thread and the angle of the thread and so on are all well-known tuneable parameters, as are the corresponding internal thread properties for a closure.

Figure 7:
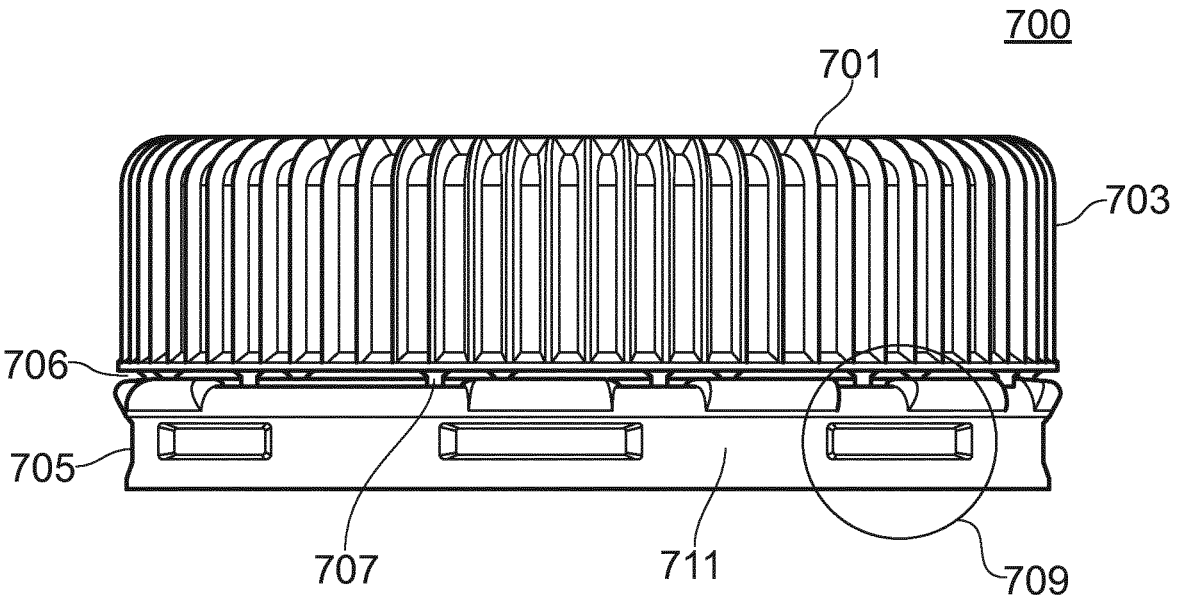
FIG. 7 is a schematic representation of a closure according to an example.

FIG. 7 is a schematic representation of a closure according to an example. The closure 700, for use with a container, a portion of which is depicted in FIG. 6 for example, includes a top panel 701, a skirt 703 extending from the periphery of the top panel 701, and a tamper indicating band 705 frangibly connected to an open end of the skirt 703 at a line of weakness 706. In an example, multiple bridges 707 can be provided to connect the skirt 703 and the band 705. The band may be connected to the skirt using a relatively thin continuous portion instead of discrete bridges. The band includes a retaining segment on an inner surface thereof (not shown) so arranged such that when the closure 700 is in a closed position on a neck of the container, it engages under an engagement surface of a retaining structure arranged on the container neck (not shown). In an example, the tamper indicating band 705 includes at least one indent 709 arranged on an outer surface 711 of the tamper indicating band 705.

Figure 8:
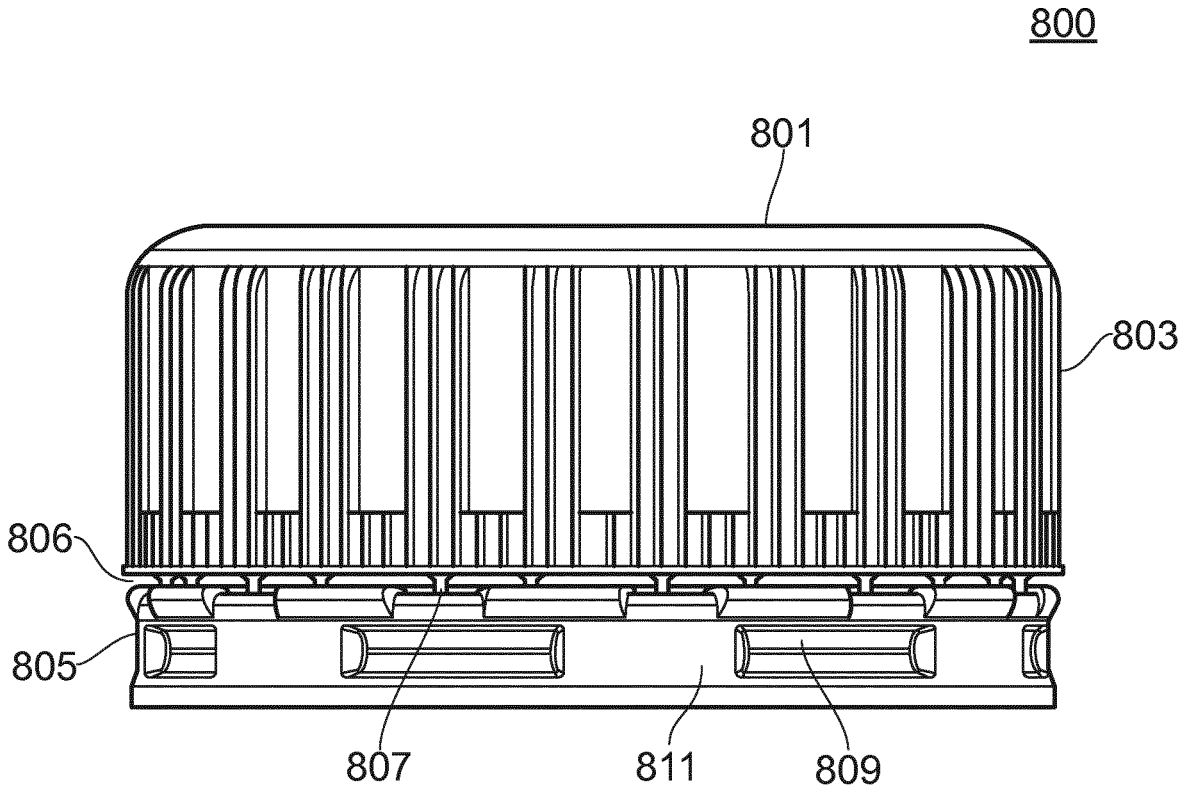
FIG. 8 is a schematic representation of a closure according to an example.

FIG. 8 is a schematic representation of a closure according to an example. The closure 800, for use with a container, a portion of which is depicted in FIG. 6 for example, includes a top panel 801, a skirt 803 extending from the periphery of the top panel 801, and a tamper indicating band 805 frangibly connected to an open end of the skirt 803 at a line of weakness 806. In an example, multiple bridges 807 are provided to connect the skirt 803 and the band 805. The band includes a retaining segment on an inner surface thereof (not shown) so arranged such that when the closure 800 is in a closed position on a neck of the container. It engages under an engagement surface of a retaining structure arranged on the container neck (not shown). In an example, the tamper indicating band 805 includes at least one indent 809 arranged on an outer surface 811 of the tamper indicating band 805.

Figure 9:
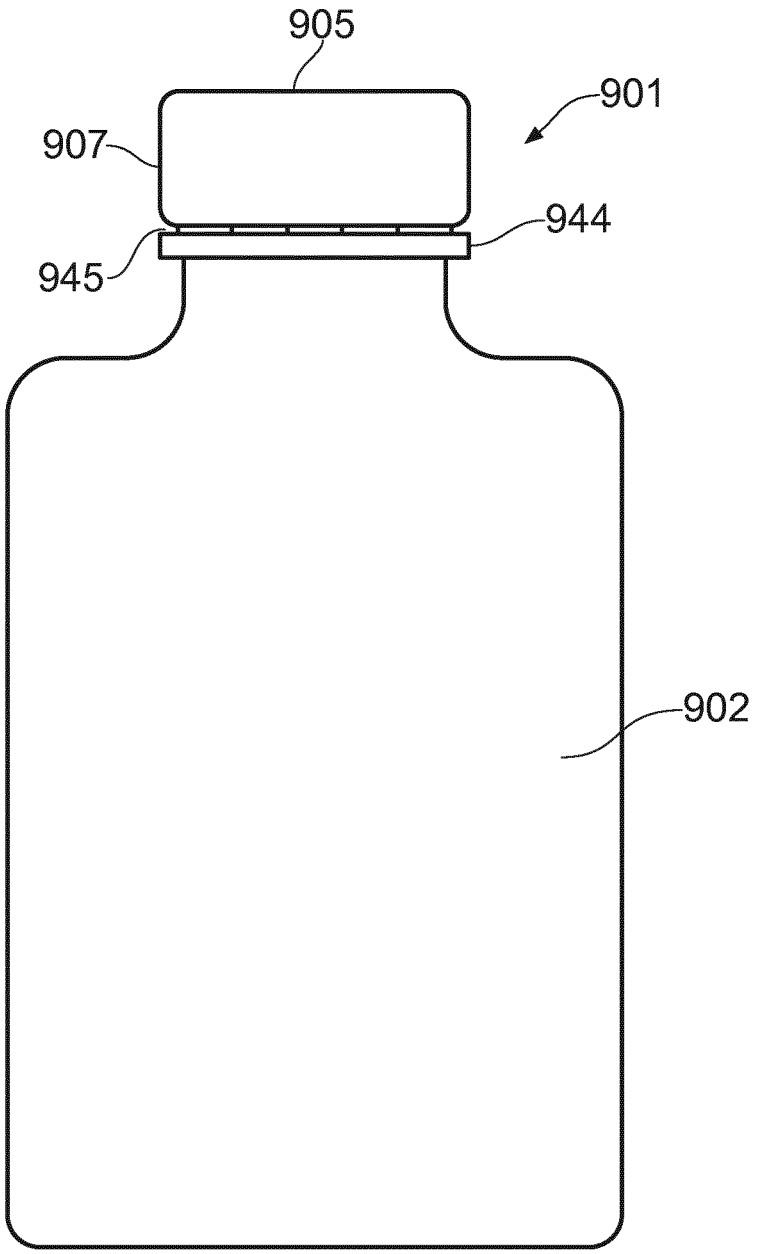
FIG. 9 is a schematic representation of a combination of a closure and a container according to an example.

FIG. 9 is a schematic representation of a combination of a closure and a container according to an example. More particularly, FIG. 9 is a view of a combination of a closure 901 according to an example comprising a top panel 905 and a cylindrical skirt 907 depending from the periphery of the top panel 905 and a container 902. The skirt 907 possesses an essentially cylindrical inside surface with at least one thread protruding radially inwards and a tamper indicating band 944 frangibly connected to the open end 945 of the skirt 907. The closure 901 and container 902 can be made of any suitable material, such as plastic, and such as polyethylene terephthalate (PET or PETE) for example, or any other suitable thermoplastic polymer for example. Container 902 can be a standard container with a standard container neck.

A closure according to an example has reduced mass, thereby enabling avoidance of deformation and providing improved de-mould-ability. Furthermore, the closure enables easier application over the bead of a container neck.

The invention claimed is:

1. A closure for a container, the closure comprising:

a top panel;

a skirt extending from the periphery of the top panel; and a tamper indicating band frangibly connected to an open end of the skirt at a line of weakness, the band including a retaining segment on an inner surface thereof so arranged, when the closure is in a closed position on a neck of the container, to engage under an engagement surface of a retaining structure arranged on the container neck, wherein the tamper indicating band includes indents distributed, in a circumferential direction around the outer surface of the tamper indicating band, wherein each of the indents has an axial dimension that is a fraction of a height of the tamper indicating band in a longitudinal direction of the closure, and a lower part and an upper part arranged to move relative to one another to form a hinge portion.

2. The closure as claimed in claim 1, wherein at least one of the indents is arranged on the outer surface of the tamper indicating band substantially opposite to the retaining segment.

3. The closure as claimed in claim 1, wherein the retaining segment is a radially inwardly extending segment.

4. The closure as claimed in claim 3, where the retaining segment is an annular retaining band.

5. The closure as claimed in claim 3, wherein the retaining segment comprises multiple retaining segments on the inner surface of the tamper indicating band for the closure.

6. The closure as claimed in claim 1, wherein the retaining segment is profiled or tapered in the circumferential direction at at least one end thereof.

7. The closure as claimed in claim 1, wherein the retaining segment is profiled or tapered in an axial direction.

8. The closure as claimed in claim 7, wherein sidewalls of at least one of the indents diverge from one another in a radial direction opposite to the retaining segment.

9. The closure as claimed in claim 7, wherein at least one of the indents has curved cross-section.

10. The closure as claimed in claim 7, wherein the tamper indicating band includes multiple rows each including at least one of the indents.

11. The closure as claimed in claim 10, wherein the multiple rows are arranged in axially spaced relation on the tamper indicating band.

12. The closure as claimed in claim 10, wherein multiple of the indents are provided in each row to provide respective circumferentially spaced rows of indents.

13. The closure as claimed in claim 10, wherein the rows of indents are arranged to provide an overlap in an axial direction between respective indents of the rows.

14. In combination, a closure as claimed in claim 1 and a container including a retaining structure arranged on a neck of the container, the retaining structure including an engagement surface under which the retaining segment engages when the closure is in a closed position on a neck of the container.

15. The combination as claimed in claim 14, wherein the container neck includes an external thread formation and wherein the skirt of the closure includes at least one internal thread formation for cooperating engagement with the external thread formation on the said container neck.

16. The combination as claimed in claim 15, wherein the external and internal thread formations are helical thread formations.

17. The closure as claimed in claim 1, wherein each of the indents has, in the circumferential direction, a circumferential dimension larger than the axial dimension of said each indent.

18. A tamper evident band for frangible connection to an open end of a skirt extending from the periphery of a top panel of a closure, the band comprising a retaining segment on an inner surface thereof so arranged, when the closure is in a closed position on a neck of the container, to engage under an engagement surface of a retaining structure arranged on a container neck, wherein the tamper indicating band includes a circumferential distribution of indents around the outer surface of the tamper indicating band, wherein each of the indents has an axial dimension that is a fraction of a height of the tamper indicating band in a longitudinal direction of the closure, and a lower part and an upper part arranged to move relative to one another to form a hinge portion, and wherein at least one of the indents is arranged on the outer surface of the tamper indicating band substantially opposite to the retaining segment.

* * * * *